United States Patent [19]

Hallez et al.

[11] Patent Number: 4,993,299

[45] Date of Patent: Feb. 19, 1991

[54] VERTICAL GANG SAW APPARATUS

[75] Inventors: Charles P. Hallez, Tellin, Belgium; Kurt Brach, Rodgan, Fed. Rep. of Germany; Vincent J. M. G. Favart, Cortil-Noirmont, Belgium; Jean-Claude O. P. Decroly, Brussels, Belgium; Pierre L. H. G. Ledru, Gembloux, Belgium; Werner Haag, Marktredwitz; Josef Hecht, Mitterteich, both of Fed. Rep. of Germany

[73] Assignee: General Electric Company, Worthington, Ohio

[21] Appl. No.: 308,163

[22] Filed: Apr. 24, 1989

[30] Foreign Application Priority Data

Mar. 25, 1988 [BE] Belgium ..... 8800347

[51] Int. Cl.[5] ..... B27B 3/10

[52] U.S. Cl. ..... 83/751; 83/780; 83/783; 83/602

[58] Field of Search ..... 83/662, 751, 768, 769, 83/775, 779, 780, 783, 786, 597, 602

[56] References Cited

U.S. PATENT DOCUMENTS

| | | | |
|---|---|---|---|
| 264,473 | 9/1882 | Nixon | 83/779 |
| 885,119 | 4/1908 | Wilkin | 83/780 |
| 2,726,687 | 12/1955 | McLachlan | 83/780 |
| 2,864,413 | 12/1958 | Arneman et al. | 83/751 |
| 3,921,489 | 11/1975 | Johansson | 83/751 |
| 4,287,800 | 9/1981 | Persson | 83/751 |
| 4,498,450 | 2/1985 | Klein | 125/16 R |

FOREIGN PATENT DOCUMENTS

| | | | |
|---|---|---|---|
| 446196 | 6/1927 | Fed. Rep. of Germany . | |
| 2638964 | 3/1978 | Fed. Rep. of Germany | 83/783 |

*Primary Examiner*—Hien H. Phan
*Assistant Examiner*—Scott A. Smith
*Attorney, Agent, or Firm*—Gary L. Loser

[57] ABSTRACT

A vertical gang saw produces an ovoidal sawing curve when the frame has at each corner attached feet that are engaged in slide bars which themselves are attached by an extremity to the body of the machine. The lower and upper slide bars undergo a synehronized swing movement that is transmitted by small drive rods. The lower drive rods are driven by an eccentric gear moved vertically. The upper drive rods are driven by an oscillating pinion with a double cam.

1 Claim, 8 Drawing Sheets

VERTICAL GANG SAW APPARATUS

BACKGROUND OF THE INVENTION

The present invention is a vertical gang saw for cutting hard materials. It comprises a body supporting the vertical frame, which is equipped with a series of gang saw blades held vertically that are activated in a backward-forward, up-and-down motion. There is also a support table holding the material to be sawed.

In particular, this invention concerns a machine with reciprocating vertical movement of the blades in which the sawing takes place in two directions.

From patent document FR-A-2498977, a saw with multiple gang saw blades to cut large blocks of marble or stone into slabs is already known. A vertical frame having relatively short saw blades is engaged with an up-and-down movement. This permits the sawing of blocks of practically unlimited length during the two displacment movements of the saw frame. The frame is guided at the midpoint and at the upper extremity of each of its sides by two Watt guide systems, each having a lever connected at each of its ends to a beam oscillating around a fixed pivot. This setup permits an approximately rectilinear guide for the frame.

In this guidance system, one of the beams can be activated by an eccentric gear in order to ensure a saw curve that is essentially circular, in order to reduce the number of teeth engaged with the block.

The eccentric gear is driven at the same rotation speed as the flywheel driving the reciprocating movement of the vertical frame. The Watt guide rods oscillate, therefore, in phase with the vertical frame.

A sophisticated balancing system compensates for the inertial forces of the parts undergoing a reciprocating movement. The system permits a speed of 260 cuts per minute.

The main disadvantage of this improved Watt arrangement lies in a fault in the sawing curve in the sense that the locus of the successive positions of the blades is an irregular curve that creates high pressure points on each of the blades at certain moments during the rocking of the frame.

These pressure points subject the levers and beams of the guidance system, and, especially, the pivot pins, to enormous stresses, which brings about premature wear of these pivot pins.

Belgian Patent No. 529856 shows a gang saw composed of one or several armored blades fixed to a vertical frame driven in a reciprocating, up-and-down, vertical movement by a crankshaft activated by a flywheel. A support table brings the marble or stone block into engagement with the saw teeth in an essentially perpendicular orientation and permits the saw plane to cross the fixed plane of the block being sawed.

The vertical orientation of the frame permits the machine to saw blocks of indefinite length, with relatively short blades, in a manner that avoids all undesirable deviations of the blade.

The machine in the Belgian patent uses gang saw blades with hard-metal teeth that are suitable for cutting during displacement in only one direction.

In order to permit a gradual cut of a block during the downward movement of the frame and to permit the disengagement of the blades during the upward movement of the frame, a synchronized swing (pendular) movement is imparted to the four corners of the frame by four connecting rods, which are interlocked by forks having four horizontal guide rods. The connecting rods are driven by four cams maintained in synchronous rotation by the main shaft that drives the saw frame.

The combination of the vertical reciprocating movement of the saw and the horizontal swing movement creates a more or less flat, ovoidal sawing trajectory, permitting a gradual penetration of the teeth along a gentle curve in one direction and the disengagement of the teeth from the marble or stone in the other direction.

Also, because of the ovoidal curve, all the blade teeth are not used with the same severity.

In each cycle, the raising of the saw blade to disengage the teeth regularly shields the blade from the pressure of sawing and permits a repeated but total abatement of this pressure. The subsequent engagement of the teeth to the stone, up to a predetermined contact pressure, induces high stresses in the blade and provokes cyclic blade deformations that are not negligible; thus the blade experiences considerable fatigue stresses and strains. These cyclical deformations of the blade lead to displacement of the blade and unfavorably influence the cleanness of the cut in the marble or stone.

SUMMARY OF THE INVENTION

The present invention intends to remedy these disadvantages. This invention discloses a vertical gang saw for cutting hard materials that has a series of gang saw blades held vertically and driven in a reciprocating up-and-down movement. It also has a support table which carries the material to be sawed. The frame of the gang saw has, near each corner, a foot that is engaged inside slide rails that are themselves slide-mounted alongside guides fixed to the frame of the machine.

The vertical gang saw employs gang saw blades equipped with diamond-impregnated teeth, which can operate in a single direction of sawing. In the teeth of a gang saw blade operating in only one direction, each abrasive grain presents behind it a volume of binding called "comet tail" that supports it during its cutting effort.

According to one aspect of this invention, the lower slide bars are each connected to a small drive rod activated by an eccentric gear moved in a vertical plane, and the upper slide bars are each connected to a small drive rod activated by a pinion gear in double-cam oscillation brought into complete rotation and traversed by a pair of rollers that transmit a swing movement to a drive arm.

The feet are joined to the frame as outlined above.

In order to minimize vibrations, the machine of this invention has a drive motor and an inertial flywheel which operate backward and forward (up and down) and are housed in a pit.

This invention pertains equally to an operational process for a vertical gang saw that is characterized by a synchronized rectilinear movement imparted to the upper slide bars of the frame by means of an oscillating pinion gear with a double cam brought into complete rotation and traversed by a pair of rollers attached around a drive shaft.

According to another aspect of this invention, a synchronized swing movement is imparted to each of the four corners of the frame, as a result of two crossed movements of translation. For each lower corner of the frame, the first movement is determined by the course of a foot along a slide bar, and the second by the sliding of the slide bar along the guides under the action of a small drive rod moved by an eccentric gear brought into rotation in a vertical plane. For each upper corner of the frame, the first of the two crossed movements is determined by the course of a foot along a slide bar, and the second by the sliding of the slide bar along the guides activated by a small drive rod moved by an oscillating pinion with a double cam in a swing movement traversed by two rollers positioned symmetrically with regard to a drive shaft.

Other particulars and details of the invention appear in the following detailed description of the preferred operational characteristics according to the invention.

THE DRAWING

In these figures, the same reference numbers designate identical or analogous elements.

DESCRIPTION OF THE INVENTION

The gang saw of this invention is a multiblade machine held in a vertical frame. It is intended to cut granite or very hard materials into relatively thin slabs.

Figure 1:
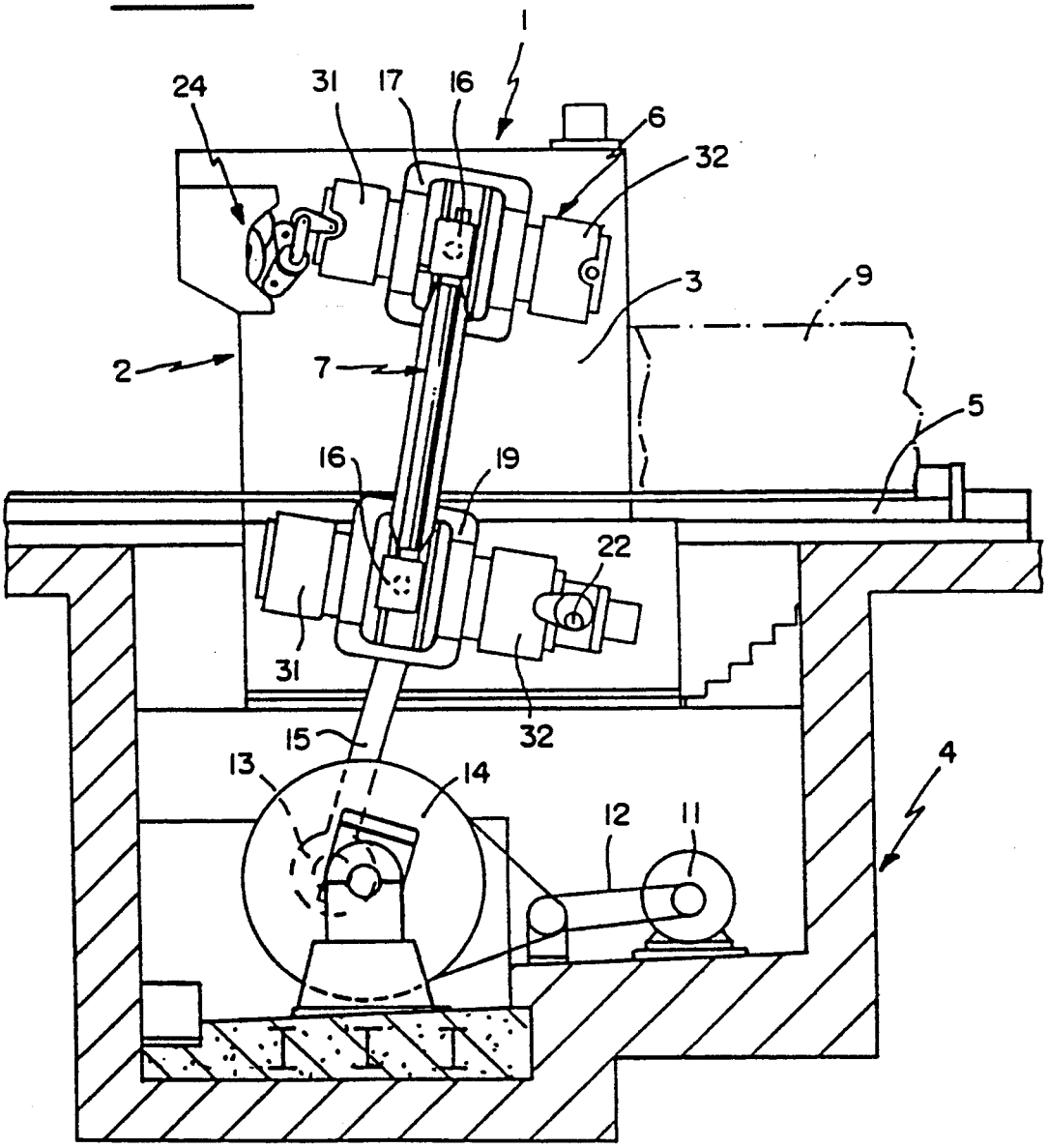
FIG. 1 is a side view of the gang saw according to this invention.

As illustrated in FIG. 1, the apparatus referred to by reference number 1, is partially set up below floor level in order to minimize vibration.

It comprises a body 2 having four pillars 3 that rest on the base 4 of a work pit, above which is mounted the support table 5 that holds the block 9 of material to be sawed. On the body 2 are mounted the support mechanisms 6 for the slide bars of the saw chassis, which consists of a vertical rectangular saw frame 7 on which are hung, by tie rods, one or several gang saw blades 8 bearing teeth suited to saw in both directions of motion of the blades'8.

The saw frame 7 is constructed of small metal beams joined at their ends by larger cross members 10 in order to form an extremely rigid rectangular framework.

Figure 2:
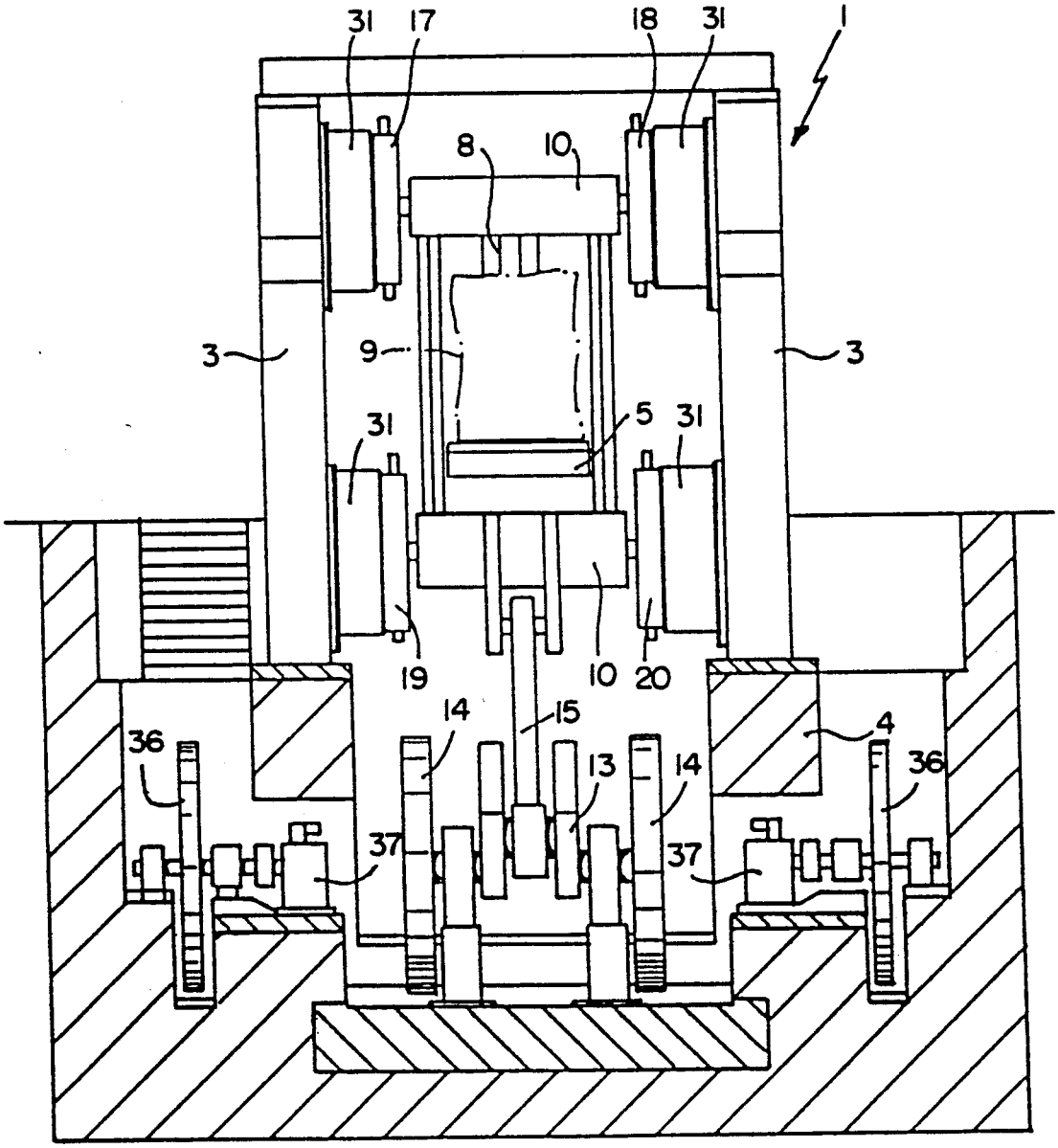
FIG. 2 is an end view of the apparatus illustrated in FIG. 1.

The frame 7 undergoes a reciprocating up-and-down movement imparted by a motor 11. As show in FIGS. 1 and 2, this motor 11 brings into rotation, through the use of belts 12, a one-throw crankshift 13 that supports two inertial flywheels 14 on either side of the crank. A driving rod 15 activates the up-and-down movement of the saw frame 7, which, near its four corners, has feet 16 engaged in the slide bars 17, 18, 19, and 20, which impose on the frame a continuous vertical motion.

The slide bars 17, 18, 19, and 20 slide-mounted to the body 2 of the machine 1 along the guides 31, 32, define a perpendicular trajectory in the direction of the slide bar guides 17, 18, 19, and 20.

The upper slide bars 17, 18 move together in parallel along the guides 31, 32 in the direction of the arrows X and Y.

Simultaneously, the lower slide bars 19, 20 move together in parallel along guides 31, 32 in the direction opposites to the arrows X and Y, making the frame pivot around a central horizontal axis that is not shown.

Figure 3:
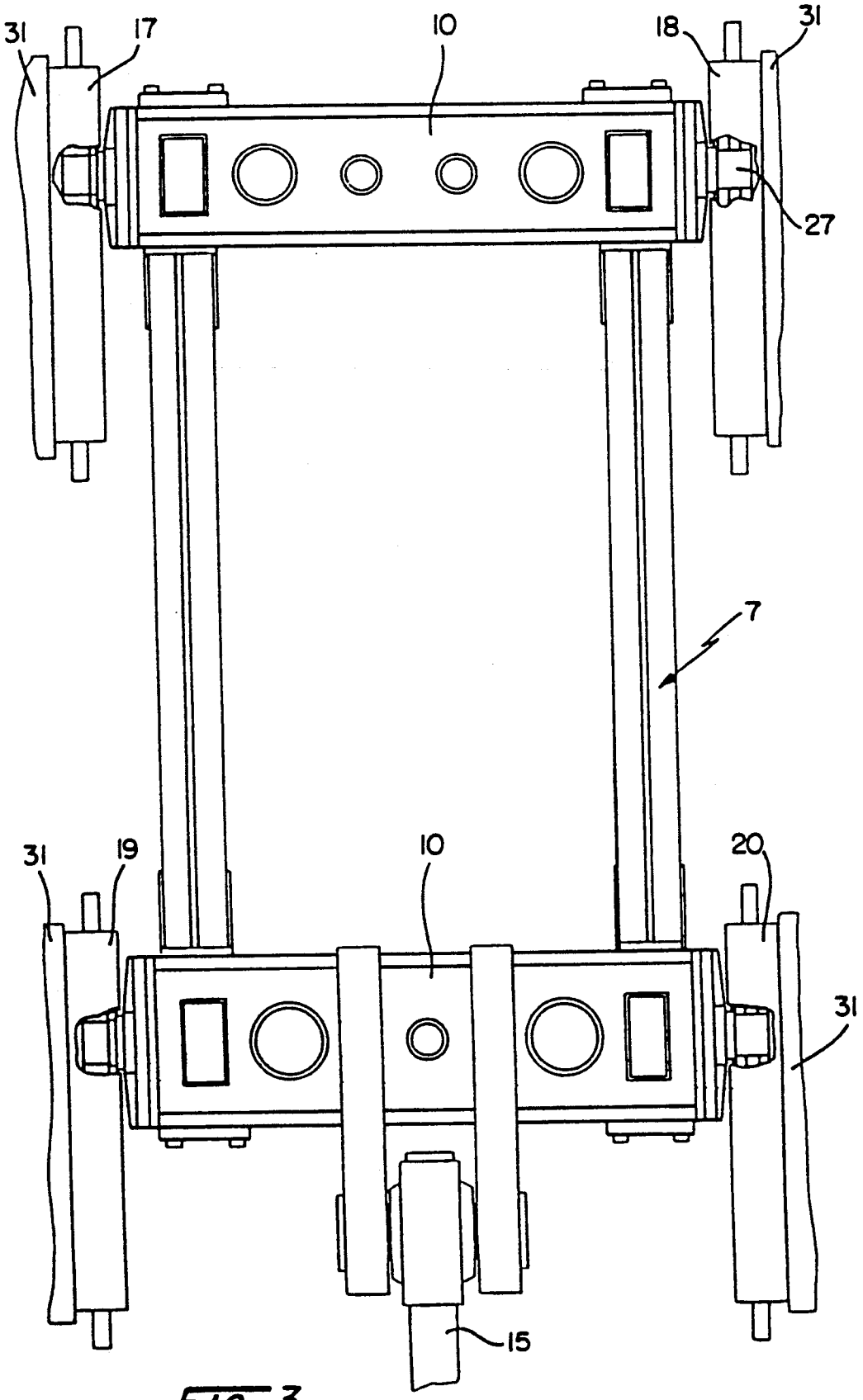
FIG. 3 is an end view with the frame partially cut away.
Figure 4:
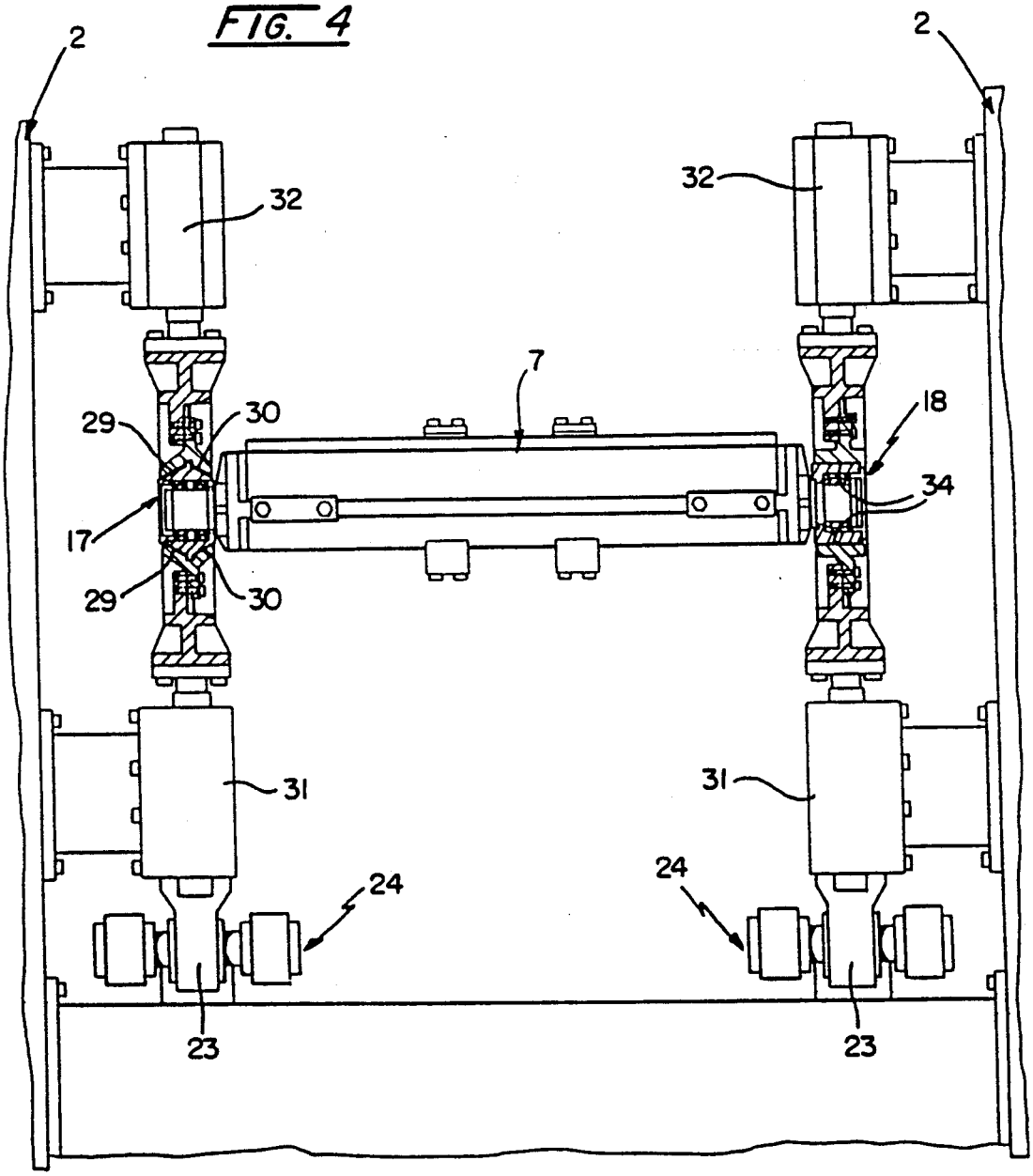
FIG. 4 is a plan view of the frame shown in FIG. 3.
Figure 5:
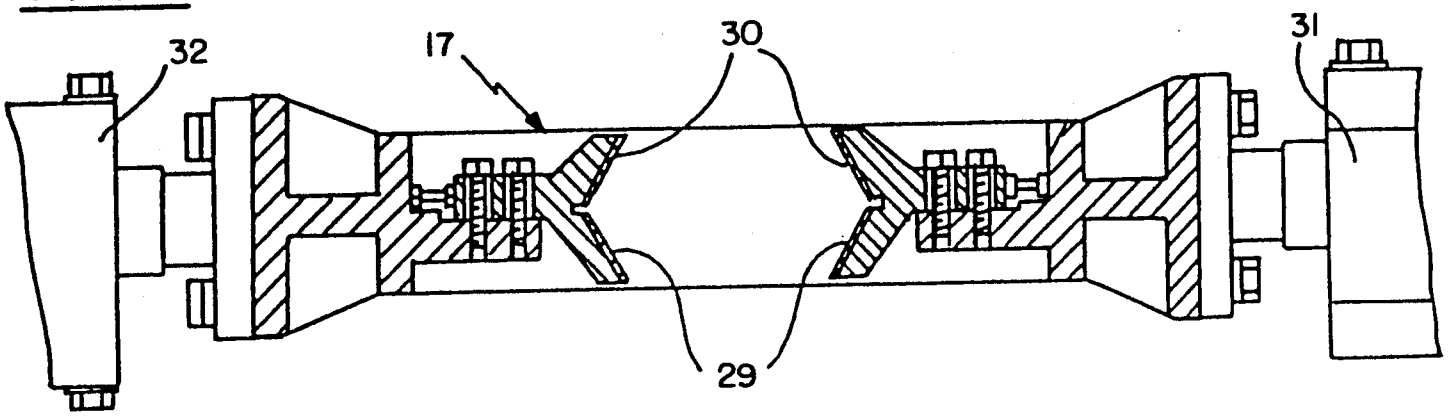
FIG. 5 is a cross-section follwing the line between VI and VI' of an upper right slide bar of the frame driven by a synchronized swing movement mechanism.
Figure 7:
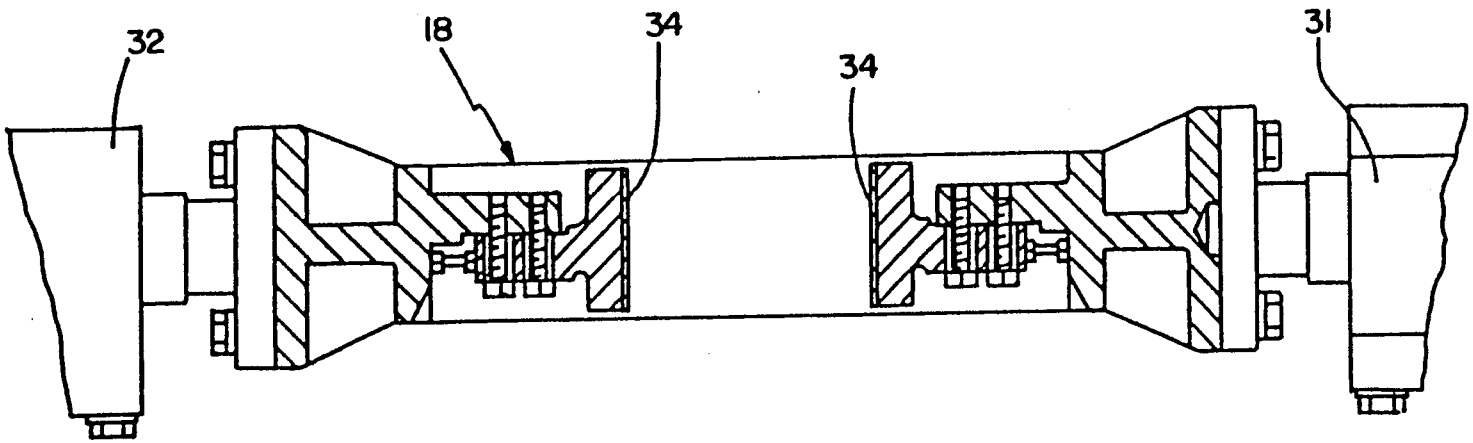
FIG. 7 is a cross section analogous to FIG. 5 of a lower left slide bar, following line VIII—VIII'.

In order to permit the pivoting movement of the frame relative to the slide bars 17, 18, 19, and 20, the feet 16 are joined to the frame by the pivots 27 shown in FIG. 3. The right slide bars 17 and 19 and the left slide bars 18 and 20 each have surface guide planes 34 and surface guides 29, 30, arranged in a V shape, that is to say, forming a certain angle between them as shown in FIGS. 5 and 7.

Slide bars 17, 18, 19, and 20 have variable positioning determined by the four small drive rods 21, 23, which impart to them an alternating rectilinear movement in the direction of arrows X and Y along the two guides 31, 32 that are fixed to the body 2 of the saw 1.

Figure 6:
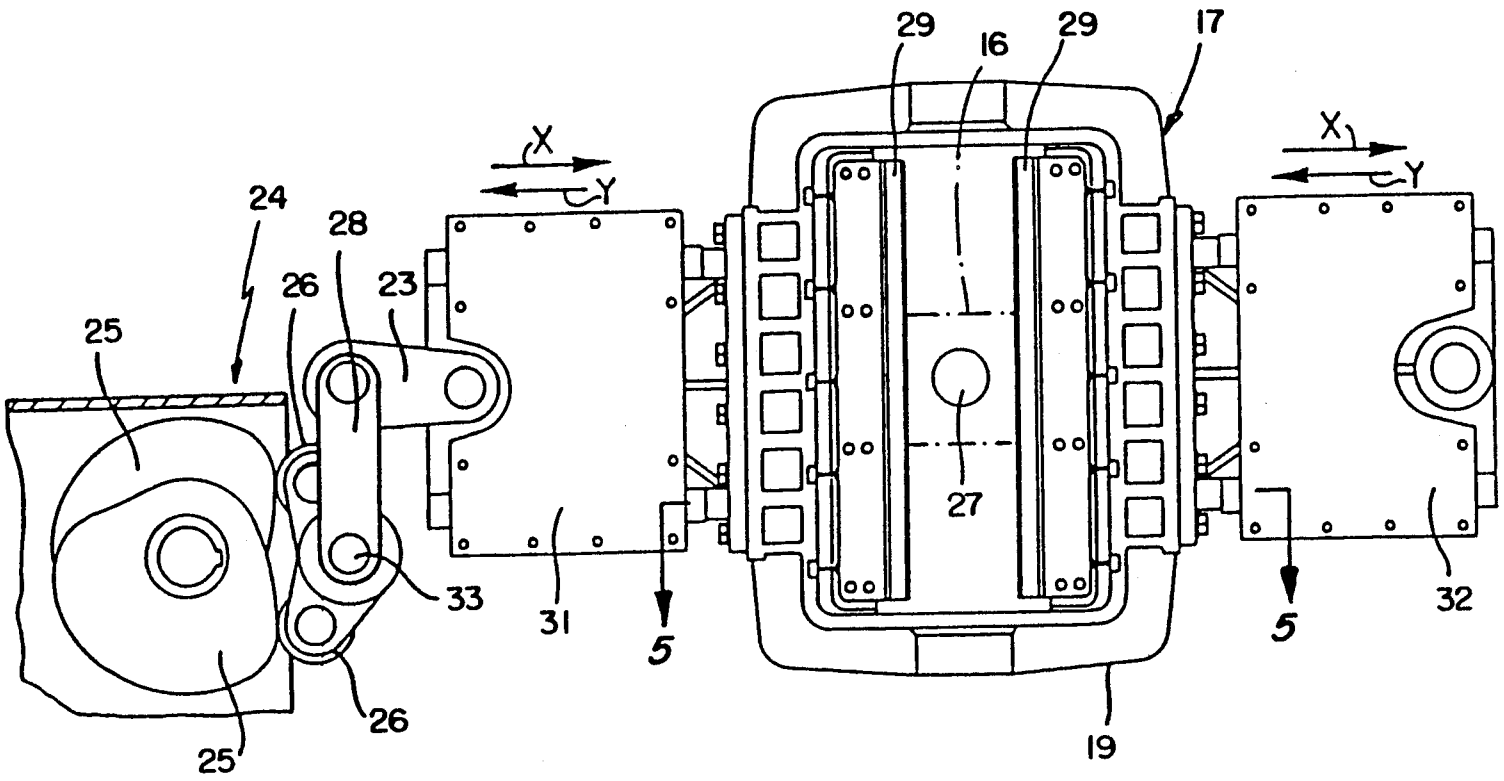
FIG. 6 is an elevated side view of the right slide bar shown in FIG. 5.

The translational movement in the direction of the arrows X and Y of the upper slide bars 17, 18 along the guides 31, 32 is achieved by the drive rod 23 activated by an oscillating pinion 24 with a double cam 25 traversed by a pair roller 26 that transmit a swing movement to a drive shaft 28 as shown in FIG. 6.

Figure 8:
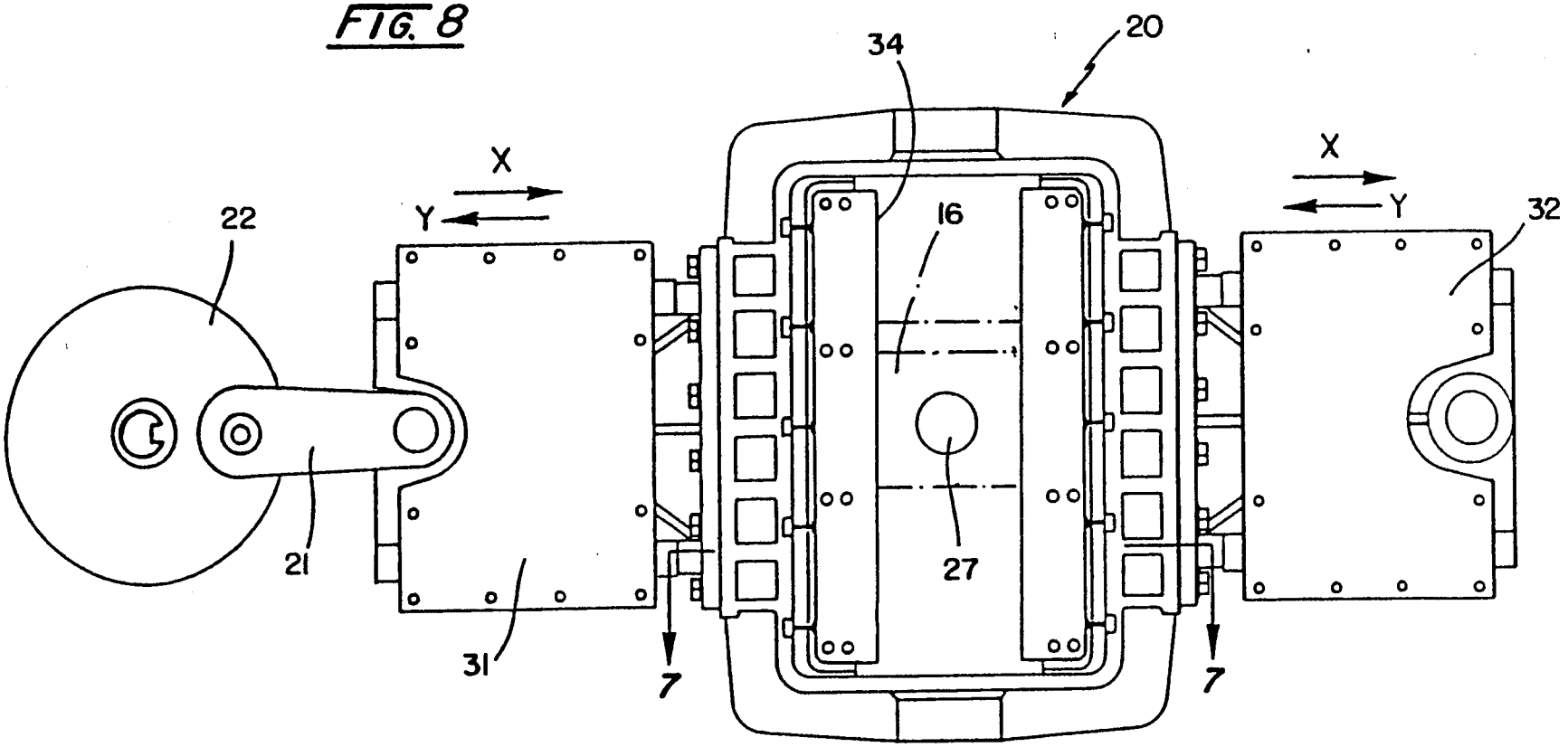
FIG. 8 is an elevated view of the lower lift slide bar shown in FIG. 7 and activated by an eccentric gear.

The translational movement in the direction of the arrows X and Y or the lower slide bars 19, 20 along the guides 31, 32 is transmitted by the small drive rod 21 moved by an eccentric gear 22 brought into rotation vertically as shown in FIG. 8.

Figure 9:
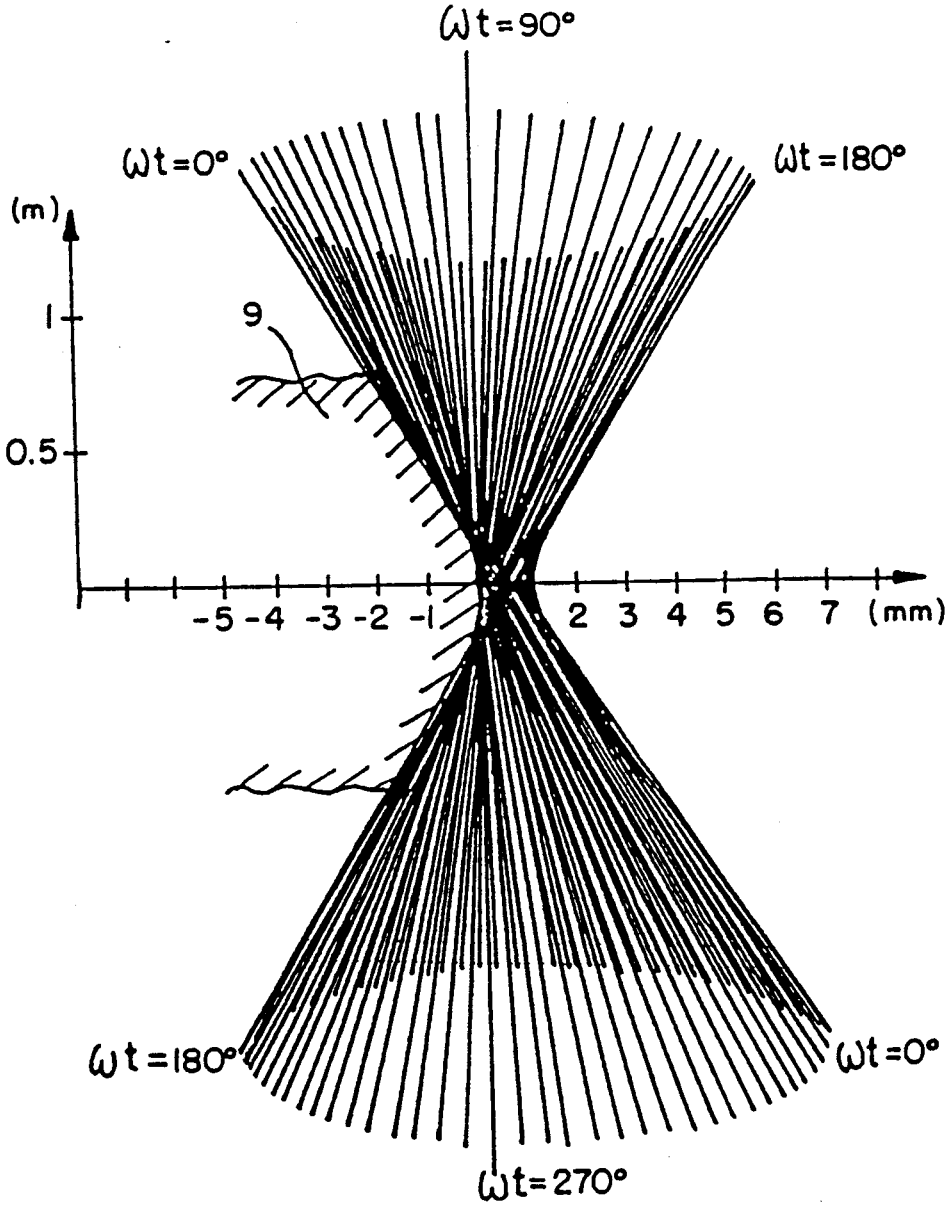
FIG. 9 shows an ovoidal sawing curve.

Owing to the synchronized movement of the slide bars, the frame 7 corners are submitted to two simultaneous movements: one is a reciprocating, rectilinear up-and-down movement; the other is a reciprocating rectilinear movement on the horizontal plane. The result is that the saw blades 8 make an ovoidal sawing trajectory with a progressive radius of curvature, as shown in FIG. 9, that allows (1) a reduction in sawing force by reducing the number of teeth in contact with the material being sawed and (2) improvement in the effectiveness of water spraying.

Gradually, the stone block is cut by imparting to the four corners of the frame a synchronized swing movement with the aid of the four attached small drive rods 21, 23 that are activated by the eccentric gear 22 and the oscillating pinion 24.

This swing movement has the effect of pulling upward the teeth that line the upper part of the gang saw blade and of pulling downward the teeth on the lower part of the gang saw blade.

The repeated disengagement of one fraction of the blade teeth permits an increase in the effectiveness of the spraying.

Since the frame oscillates in a fixed position, it is necessary to bring the block into contact with the blades. This problem is resolved with the aid of a support table such as the one described in the German Patent application No. 3735529.5. This describes a support table that permits the horizontal displacement of the block that is engaged by the blades under a determined pressure during at least a part of the two phases of blade oscillation.

We claim:

1. A vertical gang saw capable of simultaneous and synchronized reciprocating, rectilinear up-and-down movement and reciprocating, rectilinear movement in a horizontal plane, comprising a structure supporting a frame having a plurality of upper and lower corners and a series of saw blades held vertically on said frame, wherein said frame is linked at each corner by a pivot means to a corner foot that is engaged in one of a plurality of upper slide bars and lower slide bars, and wherein the lower slide bars are brought into translation by a first small drive rod driven by an eccentric gear and wherein the upper slide bars are brought into translation by a second small drive rod driven by an oscillating pinion having a double cam B'.

* * * * *